US008061551B2

(12) United States Patent
Matlovich

(10) Patent No.: US 8,061,551 B2
(45) Date of Patent: Nov. 22, 2011

(54) INSULATING HOLDER FOR BEVERAGE CONTAINER

(76) Inventor: Lisa Mary Matlovich, Sarnia (CA)

( * ) Notice: Subject to any disclaimer, the term of this patent is extended or adjusted under 35 U.S.C. 154(b) by 504 days.

(21) Appl. No.: 11/677,698

(22) Filed: Feb. 22, 2007

(65) Prior Publication Data

US 2007/0199947 A1 Aug. 30, 2007

Related U.S. Application Data

(60) Provisional application No. 60/776,723, filed on Feb. 27, 2006.

(51) Int. Cl.
*B65D 3/00* (2006.01)

(52) U.S. Cl. ..... 220/739; 220/737; 220/738; 220/903; 229/403

(58) Field of Classification Search ..... 220/737, 220/738, 739, 903; 229/403
See application file for complete search history.

(56) References Cited

U.S. PATENT DOCUMENTS

| | | | | |
|---|---|---|---|---|
| 4,625,922 | A * | 12/1986 | Brubaker et al. | 241/17 |
| 5,041,482 | A * | 8/1991 | Ornsteen et al. | 524/272 |
| 5,425,497 | A * | 6/1995 | Sorensen | 220/738 |
| 6,235,326 | B1 * | 5/2001 | Kronenberger | 426/143 |
| 6,364,151 | B1 * | 4/2002 | Gale | 220/738 |
| 7,537,136 | B2 * | 5/2009 | Hechmati | 220/739 |
| 2001/0011431 | A1 * | 8/2001 | Elias | 40/306 |
| 2004/0094557 | A1 * | 5/2004 | Sanders | 220/581 |
| 2004/0111920 | A1 * | 6/2004 | Cretinon | 36/30 R |
| 2005/0006547 | A1 * | 1/2005 | Exler | 248/311.2 |

* cited by examiner

*Primary Examiner* — Anthony Stashick
*Assistant Examiner* — Elizabeth Volz

(57) ABSTRACT

An insulating holder for a beverage container has a cylindrical or frusto-conical sleeve having a lower end, an open upper end, an inner surface and an outer surface. The sleeve is made of a resilient elastomer having heat-sensitive tackiness, for example a thermoplastic elastomer such as thermoplastic polyurethane and/or polyurea.

5 Claims, 1 Drawing Sheet

INSULATING HOLDER FOR BEVERAGE CONTAINER

CROSS-REFERENCE TO RELATED APPLICATIONS

This application is a non-provisional of U.S. Ser. No. 60/776,723, filed 27 Feb. 2006, which is incorporated by reference as if fully recited herein.

FIELD OF THE INVENTION

The disclosed embodiments of the invention relate to an insulating holder for a beverage container, particularly an insulating holder exhibiting heat-sensitive tackiness.

BACKGROUND OF THE ART

Beverage cup holders are useful for insulating the cup from a person's hand. For hot beverages, the holder protects the person's hand from being burned. Many types of holders are known in the art. However, existing holders suffer from one or more drawbacks. For example, existing holders are generally constructed from a flat blank attached to itself at a seam. Seams have a tendency to delaminate thereby rendering the holder useless, or even presenting a safety hazard if delamination occurs at an inopportune time. Existing holders do not adhere to the cup and a person's hand, therefore it is too easy for the cup to slip out of the holder and for the holder to slip out of the person's hand, thereby presenting a safety hazard. Many existing holders are not reusable, or have only limited life, which adds to the waste burden since such holders are discarded after one or only a few uses. Many existing cup holders require extensive and/or intensive multi-step manufacturing processes thereby increasing expense and manufacturing time.

Additionally, many existing cup holders cover up or obscure art work or logos on the cup, thereby reducing brand exposure. Cup holders that overcome deficiencies described above while permitting the display of art work and logos are particularly desirable. In particular, it would be desirable to have such cup holders in which art work, logos or other branding indicia may be permanently set by embossing, inking or cutting.

Accordingly, there are unmet needs in the prior art to provide an improved insulating holder for a beverage container.

SUMMARY OF THE INVENTION

There is provided an insulating holder for a beverage container comprising a cylindrical or frusto-conical sleeve having a lower end, an open upper end, an inner surface and an outer surface, the sleeve comprising a resilient elastomer having heat-sensitive tackiness.

The elastomer has heat-sensitive tackiness, thus the holder is preferably used to hold containers containing hot beverages, for example, cups for coffee, tea, hot chocolate etc. As the elastomer is warmed due to the contents of the container, it softens and becomes tackier. At the inner surface, the increased tackiness serves to increase adherence of the sleeve to the container, thereby reducing the possibility that the container will slip out of the holder. At the outer surface, the increased tackiness serves to increase adherence of the sleeve to a person's hand. As the contents of the container cools, the elastomer hardens and becomes less tacky, thus the container may be readily removed from the sleeve when the container is cool.

Preferably, the elastomer becomes tacky at temperatures in the range of about 40 to 50° C. In one embodiment, the elastomer becomes tacky at a temperature of about 50° C. or greater. In another embodiment, the elastomer becomes tacky at a temperature in a range of from about 50° C. to about 90° C. The elastomer preferably maintains its tackiness above a minimum temperature. The elastomer should not soften to the point of liquefying at normal beverage temperatures, thus, the elastomer should maintain structural integrity at temperatures of 100° C. or less.

Elastomers may provide a number of other advantages. Elastomers have an excellent combination of insulating properties, resiliency, strength, processibility and appearance. Excellent insulating properties together with strength and resiliency permit the manufacture of a relatively thin-walled holder, which reduces the weight and cost of production of the holder. Such a combination also permits the manufacture of a durable holder that may be re-used many times, thereby reducing waste burden on the environment. Elastomers may be granulated and recycled as filler in other plastic products including embodiments of the holders described herein, thereby further reducing waste burden. Processibility, resiliency and strength permit simple and inexpensive molding of the elastomer into a seamless, monolithic sleeve, thereby improving the strength and appearance of the holder. The elastomer may thus provide a durable, attractive, and easily and inexpensively manufactured holder having temperature sensitive adhesive properties, which enhances the safety and utility of the container holder.

Preferably, the elastomer comprises recycled rubber, thermoplastic elastomer or a mixture thereof. Of the thermoplastic elastomers, multi-block thermoplastic elastomers are preferred. Thermoplastic polyurethanes and/or polyureas, for example thermoplastic polyurethane/polyurea (e.g. Line-X™), are particularly preferred as they provide a particularly favorable combination of the above-mentioned advantages.

The elastomer may comprise additives such as, for example, colorants, pigments, carbon black, fibers (hemp fibers, glass fibers, carbon fibers, aramid fibers), fillers, impact modifiers, antioxidants, stabilizers, flame retardants, reheat aids, crystallization aids, acetaldehyde reducing compounds, recycling release aids, oxygen scavengers, plasticizers, flexibilizers, nucleating agents, foaming agents, mold release agents, and the like, or their combinations. Preferably, the elastomer and any additives therein are food-grade materials.

The sleeve is preferably a molded, seamless monolithic structure. Such a structure has no joint to delaminate during use thereby enhancing safety and durability of the holder. A molded, seamless monolithic structure is also more visually and tactilely attractive, and generally more durable than a structure comprised of parts attached together. In addition, a molded structure is simple and inexpensive to mass produce.

The holder may be any suitable shape for holding a beverage container. Preferably, the sleeve is cylindrical or frusto-conical. For cylindrical containers, for example soft drink bottles, beer bottles and the like, the sleeve is preferably cylindrical having a diameter somewhat less than the diameter of the bottle. The resiliency of the elastomer permits insertion of the cylindrical container into the cylindrical sleeve. For frusto-conical containers, for example, disposable coffee cups, the sleeve is preferably frusto-conical. The diameter of the lower end of the frusto-conical sleeve is smaller than the diameter of an upper part of the container so that the container can be easily inserted into the sleeve while reducing the risk of the container slipping out the lower end of the sleeve. Preferably, the sleeve is frusto-conical.

The lower end of the sleeve may be open or closed, preferably the lower end is open. An open lower end may be open such that a bottom of the container is permitted to protrude through the lower end, or the open lower end may have a perimetrical rim extending inwardly for supporting the bottom of the container. Preferably, the lower end is open permitting the bottom of the container to protrude from the lower end. Having a sleeve with an open lower end with the bottom of the container protruding therefrom permits the container, for example a disposable coffee cup, to fit in most standard automobile cup holders.

The inner surface of the sleeve may comprise protrusions to provide an air gap between the container and the sleeve. The air gap provides better insulation by allowing air to circulate between the container and the holder and by reducing thermal contact between the sleeve and the container. Protrusions may be, for example, a plurality of spaced-apart knobs or a plurality of ribs extending between the lower and upper ends of the sleeve.

The outer surface of the sleeve may be textured to provide a better gripping surface, to provide a more attractive appearance and/or to provide air gaps between the sleeve and a person's hand, although tackiness is viewed as the primary means through which the grip is enhanced.

The sleeve may have fold lines at which the sleeve is thinner to facilitate folding of the holder into a flat and easily storable and transportable form. The fold lines preferably extend from the lower end to the upper end of the sleeve. The fold lines are preferably on the outer surface of the sleeve.

The outer surface of the sleeve may comprise indicia, for example, advertisements, trademarks, trade names, art work, textual matter, etc. The indicia may be tailored to be representative of the establishment distributing beverages in beverage containers, e.g. coffee shops. The indicia may be printed on the outer surface, cut into the outer surface, or molded into the outer surface, during or after manufacture of the holder. Preferably, the indicia are molded and/or cut into the outer surface. Molding and/or cutting provides for more permanent indicia. The indicia may be molded and/or cut partially into the sleeve or all the way through the sleeve between the outer and inner surfaces. If the indicia are cut all the way through the sleeve, the container would be visible through the indicia when the sleeve surrounds the container.

Holders are preferably manufactured by a molding process, preferably a spray molding or injection molding process. Such processes readily permit the manufacture of seamless, monolithic holders in a simple, inexpensive manner. Spray molding processes may be used for thermoplastic elastomers. Injection or extrusion molding processes are preferred for recycled rubber. Molding processes permit simple and integrated formation of other features of the holder, for example, the textured outer surface, the protrusions on the inner surface, the fold lines and the indicia as discussed above.

Further features will be described or will become apparent in the course of the following detailed description.

BRIEF DESCRIPTION OF THE DRAWINGS

In order that the scope of the invention will be more clearly understood, embodiments thereof will now be described in detail by way of example, with reference to the accompanying drawings, in which.

DESCRIPTION OF PREFERRED EMBODIMENTS

Figure 1:
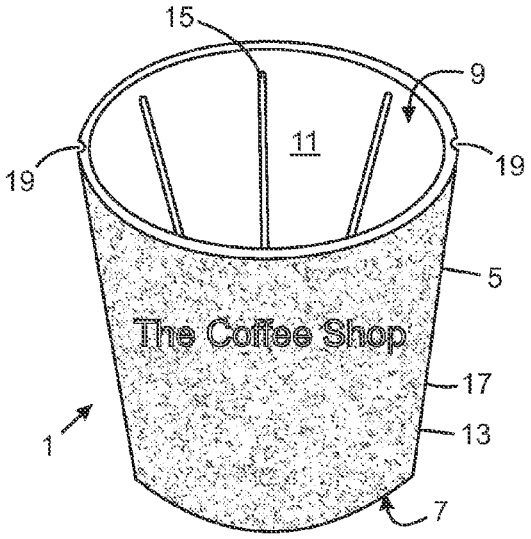
FIG. 1 is a perspective view of an embodiment of the container holder.
Figure 2:
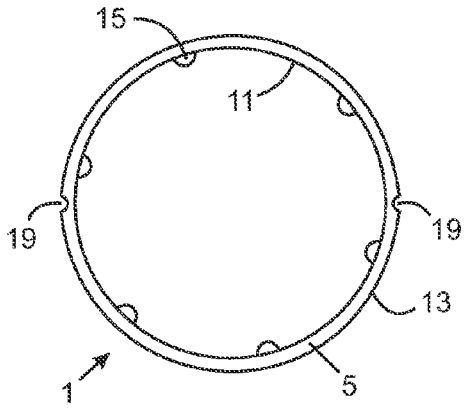
FIG. 2 is a plan cross-sectional view of the FIG. 1 holder.
Figure 3:
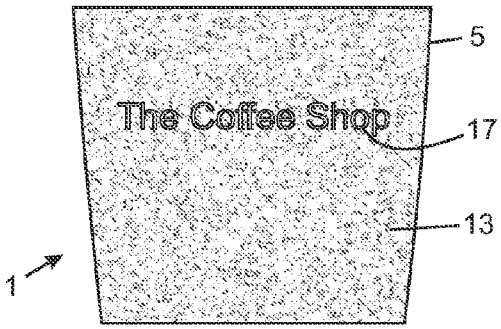
FIG. 3 is a side view of the FIG. 1 holder.

Referring to FIGS. 1-4, coffee cup holder 1 comprises molded, seamless, monolithic frusto-conical sleeve 5 having open lower end 7, open upper end 9, inner surface 11 and textured outer surface 13. In one embodiment, the sleeve is manufactured by spray molding a spray-on thermoplastic polyurethane/polyurea on to an exterior surface of a frusto-conical mold. The texture on outer surface 13 results directly from the spray molding process, requiring no further processing to obtain that texture.

Inner surface 11 comprises a plurality of vertically oriented ribs 15 (only one labeled) to provide air gaps between sleeve 5 and disposable coffee cup 21. The ribs are integrally formed on the inner surface of the sleeve during the molding process by corresponding cavities on the frusto-conical mold. Outer surface 13 comprises indicia 17, which in the Figures is the phrase "The Coffee Shop". Indicia 17 are laser cut all the way through the sleeve between the outer and inner surfaces so that coffee cup 21 is visible through the lettering of the indicia.

Outer surface 13 further comprises two diametrically opposed vertical grooves 19 extending from lower end 7 to upper end 9. The sleeve is thinner at grooves 19 so that the sleeve may be folded flat with the grooves forming the edges of the folded sleeve. The grooves are formed during the molding process by corresponding ridges on the frusto-conical mold.

Figure 4:
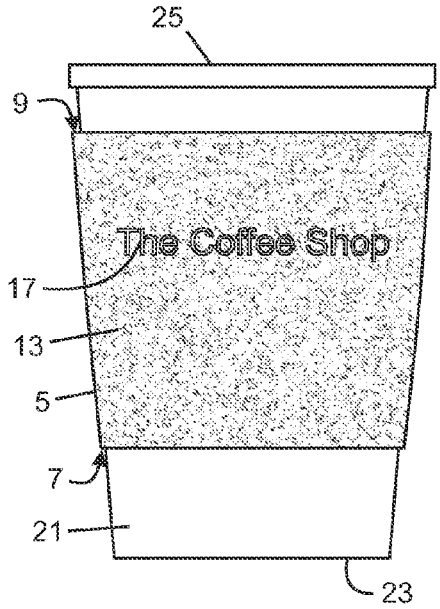
FIG. 4 is a side view of the FIG. 1 holder, operativelty engaging a coffee cup.

As seen in FIG. 4, coffee cup 21 extends through sleeve 5 so that bottom 23 of the coffee cup protrudes from lower end 7, and top 25 of the coffee cup is above upper end 9 of the sleeve. The coffee cup is frusto-conical and sits snugly within frusto-conical sleeve 5. The thermoplastic polyurethane/polyurea is resilient to provide good surface contact between the ribs 15 and the outside surface of the cup. As the ribs are warmed due to conduction of heat from hot coffee in the cup, the thermoplastic polyurethane/polyurea becomes sufficiently tacky to provide an adhesive bond between the ribs and the cup, thereby more securely holding the cup in the sleeve. Once the coffee has been consumed, or once the coffee has been allowed to cool sufficiently, the adhesive bond weakens and removing the cup from the sleeve is readily accomplished.

Other advantages which are inherent to the structure are obvious to one skilled in the art. The embodiments are described herein illustratively and are not meant to limit the scope of the claims. Variations will be evident to a person of ordinary skill and are intended by the inventor to be encompassed by the following claims.

What is claimed is:

1. A reusable insulating holder for a beverage container suitable for a further said use comprising:

a sleeve, of a cylindrical or frusto-conical shape, having an open lower end, an open upper end, and inner and outer surfaces;

wherein the material of the sleeve is a resilient thermoplastic elastomer exhibiting a heat-sensitive tackiness in response to the heat of the beverage and whereas the presence of said heat results in tackiness on said inner and outer surfaces and whereas the absence of said heat eliminates said tackiness;

wherein the sleeve is removable and reusable for a further said use;

wherein the thermoplastic elastomer is a multi-block polymer; and wherein the sleeve is a molded, seamless monolithic structure.

2. The holder of claim 1, wherein:

the elastomer comprises a thermoplastic polyurethane and/or polyurea.

3. The holder of claim 1, wherein:

the inner surface comprises protrusions to provide an air gap between the container and the sleeve.

4. The holder of claim 1, wherein:

the outer surface comprises indicia and the indicia are formed into the outer surface by a process selected from at least one of: molding and incising.

5. A reusable insulating holder for a beverage container suitable for a further said use comprising:

a sleeve, of a cylindrical or frusto-conical shape, having an open lower end, an open upper end, and inner and outer surfaces;

wherein the material of the sleeve is a resilient thermoplastic elastomer exhibiting a heat-sensitive tackiness in response to the heat of the beverage and whereas the presence of said heat results in tackiness on said inner and outer surfaces and whereas the absence of said heat eliminates said tackiness;

wherein the sleeve is removable and reusable for a further said use;

wherein the thermoplastic elastomer is a multi-block polymer; and wherein the sleeve comprises fold lines at which the sleeve is thinner, the fold lines comprising grooves in the outer surface extending from the lower end to the upper end of the sleeve.

* * * * *